United States Patent [19]

Kikuchi et al.

[11] Patent Number: 4,878,817

[45] Date of Patent: Nov. 7, 1989

[54] WOBBLE PLATE TYPE COMPRESSOR WITH VARIABLE DISPLACEMENT MECHANISM

[75] Inventors: Sei Kikuchi; Kiyoshi Terauchi, both of Isesaki; Kazuhiko Takai, Maebashi; Teruo Higuchi, Isesaki, all of Japan

[73] Assignee: Sanden Corporation, Gunma, Japan

[21] Appl. No.: 158,711

[22] Filed: Feb. 22, 1988

[30] Foreign Application Priority Data

Feb. 20, 1987 [JP] Japan ..... 62-35910

[51] Int. Cl.[4] ..... F04B 1/26

[52] U.S. Cl. ..... 417/222 S; 417/270

[58] Field of Search ..... 417/222 S, 269, 270

[56] References Cited

U.S. PATENT DOCUMENTS

| | | | |
|---|---|---|---|
| 3,062,020 | 11/1962 | Heidorn . | |
| 3,810,488 | 5/1974 | Orth et al. . | |
| 3,861,829 | 1/1975 | Roberts et al. . | |
| 4,037,993 | 7/1977 | Roberts . | |
| 4,061,443 | 12/1977 | Black et al. . | |
| 4,073,603 | 2/1978 | Abendschein et al. . | |
| 4,174,191 | 11/1979 | Roberts . | |
| 4,428,718 | 1/1984 | Skinner . | |
| 4,480,964 | 11/1984 | Skinner . | |
| 4,526,516 | 7/1985 | Swain et al. . | |
| 4,576,554 | 3/1986 | Wagenseil | 417/270 |
| 4,580,950 | 4/1986 | Sumikawa et al. . | |
| 4,606,705 | 8/1986 | Parekh . | |
| 4,632,640 | 12/1986 | Terauchi . | |
| 4,664,604 | 5/1987 | Terauchi | 417/222 S |
| 4,685,866 | 8/1987 | Takenaka et al. . | |
| 4,687,419 | 8/1987 | Suzuki | 417/222 S |
| 4,730,986 | 3/1988 | Kayukawa et al. . | |
| 4,780,059 | 10/1988 | Taguchi . | |
| 4,780,060 | 10/1988 | Terauchi . | |

FOREIGN PATENT DOCUMENTS

| | | | |
|---|---|---|---|
| 1249692 | 9/1967 | Fed. Rep. of Germany . | |
| 3545581 | 7/1986 | Fed. Rep. of Germany . | |
| 3603931 | 8/1986 | Fed. Rep. of Germany . | |
| 58-158382 | 9/1983 | Japan . | |
| 115480 | 7/1984 | Japan | 417/270 |
| 61-145379 | 12/1984 | Japan . | |
| 61-55380 | 3/1986 | Japan . | |
| 215469 | 9/1986 | Japan | 417/222 S |
| 61-261681 | 11/1986 | Japan . | |
| 87679 | 4/1987 | Japan | 417/222 S |
| 2155116 | 9/1985 | United Kingdom . | |

*Primary Examiner*—William L. Freeh

*Attorney, Agent, or Firm*—Banner, Birch, McKie & Beckett

[57] ABSTRACT

A slant plate type compressor with a capacity or displacement adjusting mechanism. The compressor includes a housing having a cylinder block provided with a plurality of cylinders and a crank chamber. A piston is slidably fitted within each of the cylinders and is reciprocated by a drive mechanism which includes a member having a surface with an adjustable incline angle. The incline angle is controlled by the pressure condition in the crank chamber. The pressure in the crank chamber is controlled by a control mechanism which comprises a passageway communicating between the crank chamber and a suction chamber, and valve to control the closing and opening of the passageway. The valve is disposed in a central bore which is formed in the cylinder block and supports one end of a drive shaft. A conduit extends from the central bore through the cylinder block and to the suction chamber.

21 Claims, 5 Drawing Sheets

WOBBLE PLATE TYPE COMPRESSOR WITH VARIABLE DISPLACEMENT MECHANISM

FIELD OF THE INVENTION

The present invention relates to a slant plate type compressor with a variable displacement mechanism, and more particularly, to the position of a control mechanism for controlling the capacity of the compressor.

BACKGROUND OF THE INVENTION

Slant plate type compressors such as wobble plate type compressors which reciprocate pistons by converting the rotational motion of a cam rotor into nutational motion of a wobble plate are well known in the art. Such a variable displacement wobble plate compressor is disclosed in Japanese Patent Application Publication No. 58-158,382. Changing the inclined angle of the wobble plate changes the stroke of the pistons and therefore changes the displacement volume of the cylinders.

Referring to FIG. 1, the construction of a conventional wobble plate type compressor is shown. Wobble plate type compressor 1 includes front end plate 2, cylinder casing 3 having cylinder block 31, valve plate 4 and cylinder head 5. Front end plate 2 is fixed on one end of cylinder casing 3 by securing bolts (not shown). Axial hole 21, which is formed through the center of front end plate 2, receives drive shaft 7. Radial bearing 8 is disposed in axial hole 21 to rotatably support drive shaft 7. Annular sleeve portion 22 projects from front end plate 2 and surrounds drive shaft 7, thereby defining a seal cavity. Cylinder casing 3 is provided with cylinder block 31 and crank chamber 32. Cylinder block 31 has a plurality of equiangularly spaced cylinders 33 formed therein.

Cam rotor 9 is fixed on drive shaft 7 by pin 103. Thrust needle bearing 10 is disposed between the inner wall surface of front end plate 2 and the adjacent axial end surface of cam rotor 9. Arm portion 91 of cam rotor 9 extends in a direction toward cylinder block 31. Elongated hole or slot 92 is formed on arm portion 91. Inclined plate 11, provided with flange portion 111, arm portion 112 and cylindrical portion 113, is disposed around drive shaft 7. Arm portion 112 is formed on the outer surface of flange portion 111 of inclined plate 11 and faces arm portion 91 of cam rotor 9. A hole (not shown) which is formed in arm portion 112, is aligned with elongated hole or slot 92. Guide pin 12 is fixedly inserted in the hole so that an end portion of guide pin 12 is slidably movable within elongated hole 92. Ring shaped wobble plate 13 is mounted on the outer surface of cylindrical portion 113 of inclined plate 11 through radial bearing 14 and is prevented from axial movement by flange portion 111 and snap ring 15 which is disposed on cylindrical portion 113. Wobble plate 13 is also prevented from rotating by guide plate 25 which extends within crank chamber 32. Thrust needle bearing 16 is disposed in a gap between flange portion 111 and wobble plate 13. The outer end of drive shaft 7 is rotatably supported through radial bearing 17 in the central bore 34 of cylinder block 31. One end of piston rod 18 is rotatably connected to receiving surface 131 of wobble plate 13. The other end of piston rod 18 is rotatably connected to piston 19 which is slidably fitted within cylinder 33.

Suction ports 41 and discharge ports 42 are formed through valve plate 4. A suction reed valve (not shown) and a discharge reed valve (not shown) are oppositely disposed on valve plate 4. Cylinder head 5 is connected to cylinder casing 3 through gaskets (not shown) and valve plate 4. Partition wall 51 extends axially from the inner surface of cylinder head 5 and divides the interior of cylinder head 5 into annular suction chamber 52 and discharge chamber 53. Annular suction chamber 52 is connected to the external fluid circuit through fluid inlet port 54 formed in cylinder head 5. Discharge chamber 53 is connected to the external fluid circuit through fluid outlet port 55 formed in cylinder head 5.

Crank chamber 32 of cylinder casing 3 and suction chamber 52 of cylinder head 5 are connected to one another through bypass conduit 311. Bypass conduit 311 permits control of the pressure in crank chamber 32 to control the angle of inclined plate 11 and wobble plate 13. Conduit 311, formed within cylinder block 31, provides communication between crank chamber 32 of cylinder casing 3 with suction chamber 52 of cylinder head 5. Conduit 311 includes passage **311*a*, and hollow portion 311*b* having control valve 20 therein. Control valve 20 controls the opening and closing of conduit 311 in response to the difference between the gas pressure in crank chamber 32 and that in suction chamber 52. Thus, conduit 311 introduces the fluid gas from crank chamber 32 to suction chamber 52 in response to operation of control valve 20. Control valve 20 includes bellows 20*a*, under vacuum, and needle valve 20*b*. One end of bellows 20*a* is mounted on a projection formed on the inner wall surface of hollow portion 311*b*. Needle valve 20*b* is fixed on the other end of bellows 20*a*. When the pressure in crank chamber 32 is greater than the operating pressure point of bellows 20*a*, bellows 20*a* contracts with needle valve 20*b* moving therewith, thereby opening hole 43 in valve plate 4. Accordingly, the high pressure gas in crank chamber 32 flows into suction chamber 52, thereby reducing the pressure in crank chamber 32**.

In the above construction of a wobble plate type compressor with a variable displacement mechanism, it is necessary to form bypass conduit 311 in cylinder block 31 to dispose control valve 20 therein. Furthermore, since hollow portion **311*b* is formed outside of the circumference of the plurality of cylinders 33, the outer surface of cylinder casing 3 projects in the radial direction as shown in FIG. 2. Alternatively, if hollow portion 311*b* is formed on the circumference of cylinders 33 to prevent cylinder casing 3 from so projecting, respective cylinders 33 could not be disposed at regular intervals, e.g., equiangularly spaced, thereby causing pulsation of the gas pressure. Furthermore, if control valve 20** is disposed within a cylinder head, the volume of the suction chamber and discharge chamber is reduced. This configuration also causes increased pulsation of the gas pressure.

The angle of inclination of inclined plate 11 and wobble plate 13 is dependent on the fluid pressure in crank chamber 32. If the communication between crank chamber 32 and suction chamber 52 is prevented by closing control valve 20, fluid pressure in crank chamber 32 gradually increases. The high fluid pressure in crank chamber 32 acts on the rear surface of pistons 19 thereby reducing the angle of inclination of inclined plate 11 and wobble plate 13. The capacity of the compressor is also reduced. On the other hand, if crank chamber 32 and suction chamber 52 are in communication with each other, as when control valve 20 is open, fluid pressure in crank chamber 32 is reduced thereby affecting the increase in the angle of inclination of inclined plate 11 and wobble plate 13. The capacity of the compressor is increased as well.

SUMMARY OF THE INVENTION

It is a primary object of this invention to provide a slant plate type compressor with a variable displacement mechanism which can be easily and efficiently assembled during manufacture.

It is another object of this invention to provide a slant plate type compressor with a variable displacement mechanism of which the compressor housing can be formed in the shape of a cylinder.

The present invention is directed to a slant plate type compressor with a variable displacement mechanism. The compressor includes a compressor housing having a central portion, a front end plate at one end and a cylinder head provided with a suction and discharge chamber at its other end. The housing surrounds a cylinder block provided with a plurality of cylinders, a piston slidably received in each of the cylinders and a crank chamber adjacent the cylinder block. A central bore is formed in the cylinder block for rotatably supporting one end of a drive shaft. A rotor is coupled to the drive shaft to be rotatable therewith. A coupling mechanism drivingly couples the rotor to the pistons such that the rotary motion of the rotor is converted into reciprocating motion of the pistons. The coupling mechanism includes a member having a surface disposed at an incline angle relative to the longitudinal axis of the drive shaft. A control mechanism is provided in the central bore for controlling fluid communication between the crank chamber and the suction chamber to vary the angle of the incline member, the stroke length of the pistons and the capactity of the compressor. A conduit extends from the central bore, through the cylinder block and to the suction chamber to provide fluid communication between the control mechanism and the suction chamber.

Further objects, features and other aspects of the invention will be understood from the following description of the preferred embodiments of the invention referring to the attached drawings.

DETAILED DESCRIPTION OF THE PREFERRED EMBODIMENT

Figure 1:
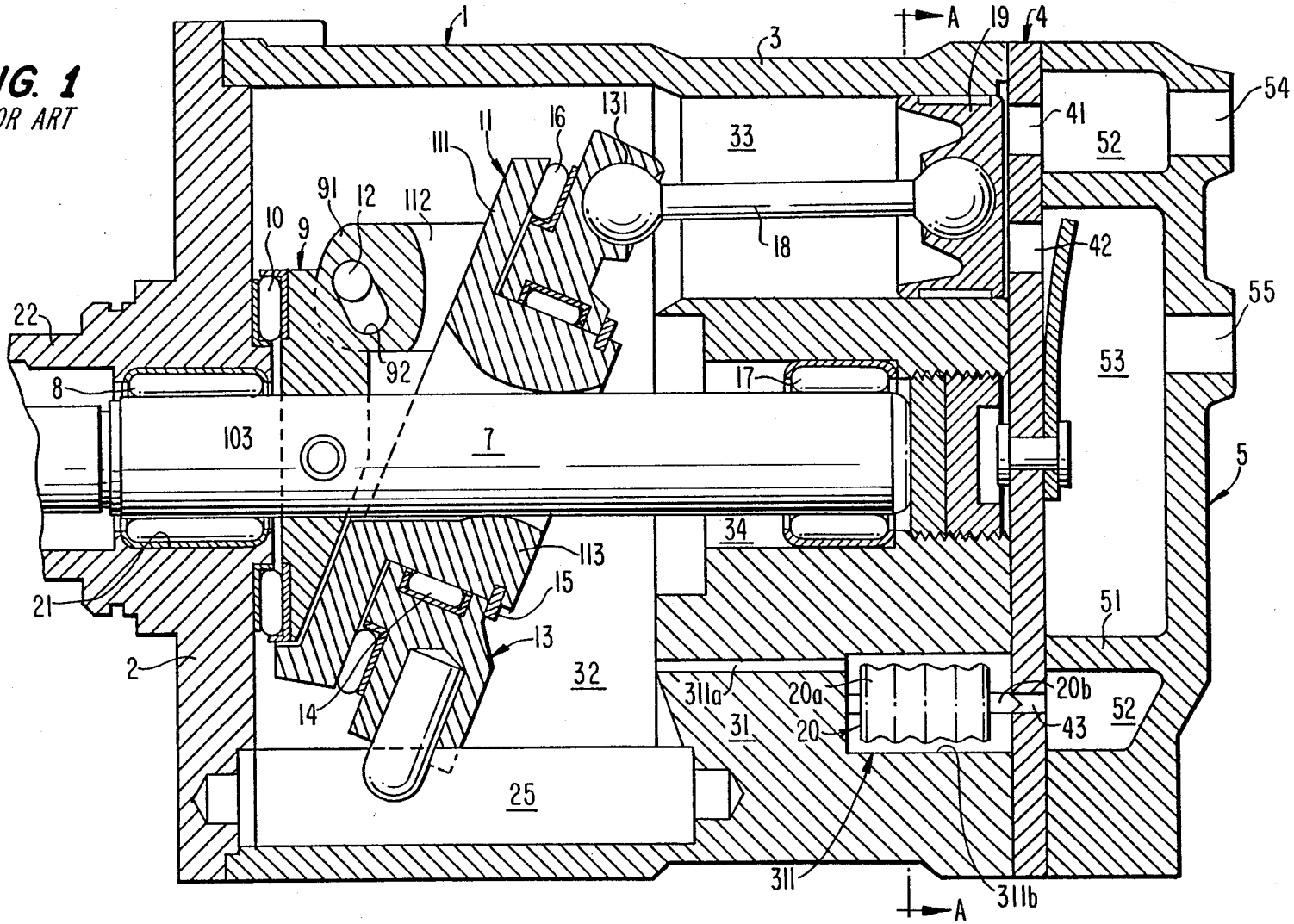
FIG. 1 PRIOR ART
FIG. 1 is a cross-sectional view of a conventional wobble plate type compressor with a variable displacement mechanism.
Figure 2:
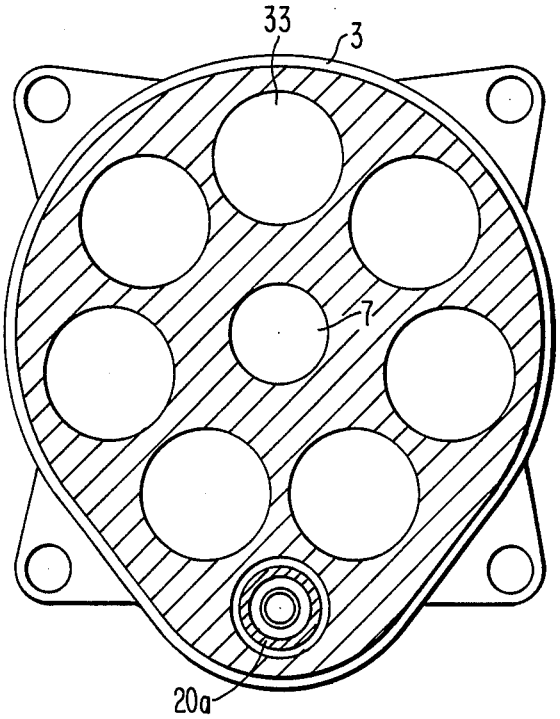
FIG. 2 PRIOR ART
FIG. 2 is a cross-sectional view taken along line A—A of FIG. 1.
Figure 5:
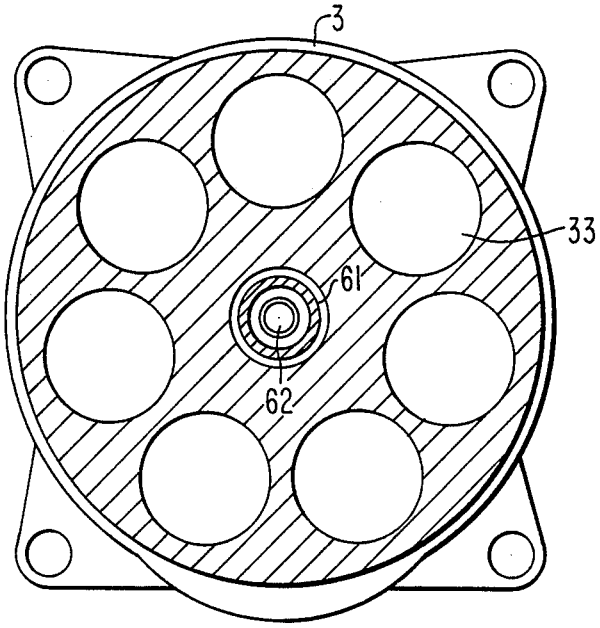
FIG. 5 is a cross-sectional view taken along line B—B of FIG. 4.
Figure 3:
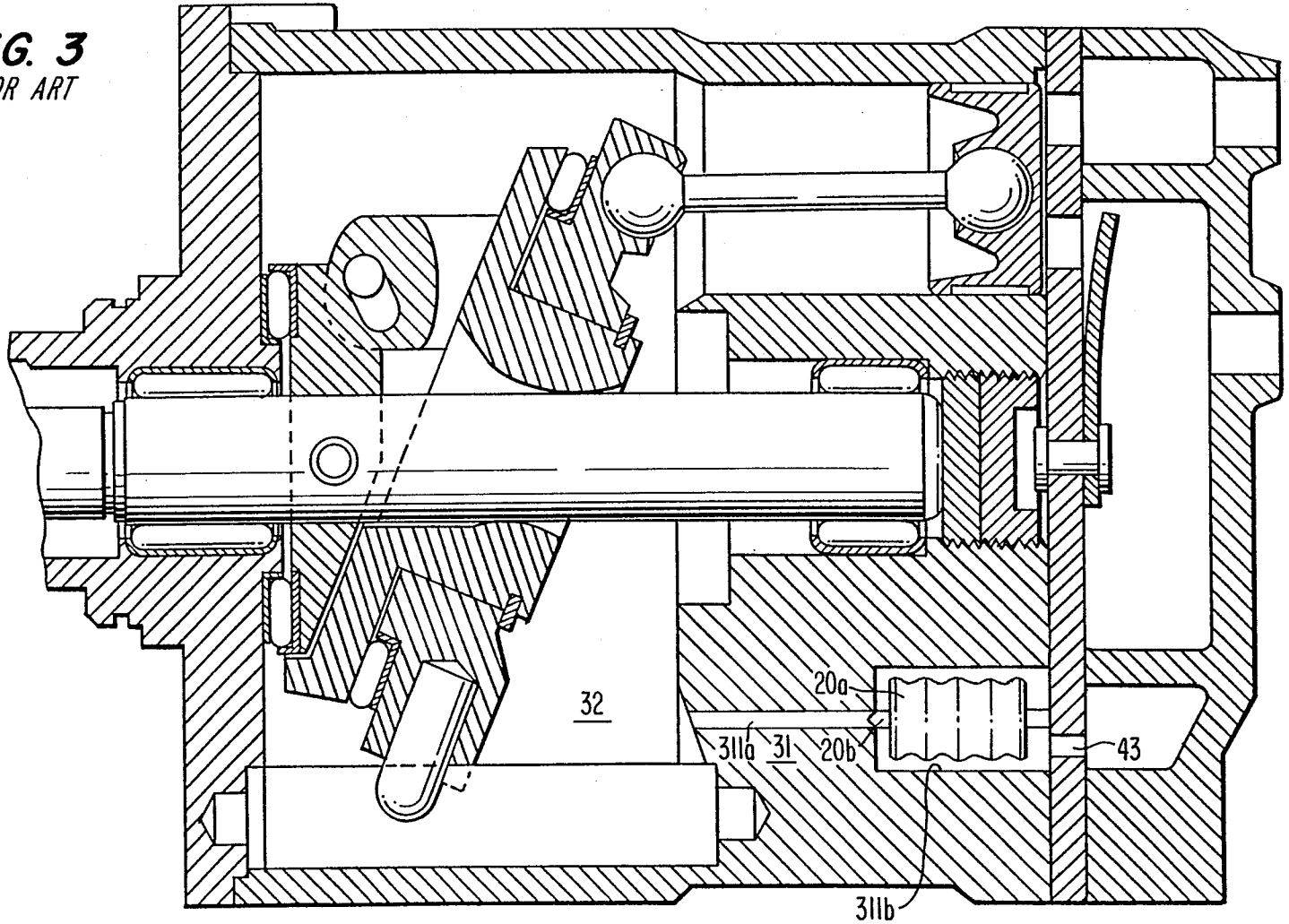
FIG. 3 PRIOR ART
FIG. 3 is a cross-sectional view of another conventional wobble plate type compressor with a variable displacement mechanism and having a valve similar to that of FIG. 2, but turned 180 degrees.
Figure 4:
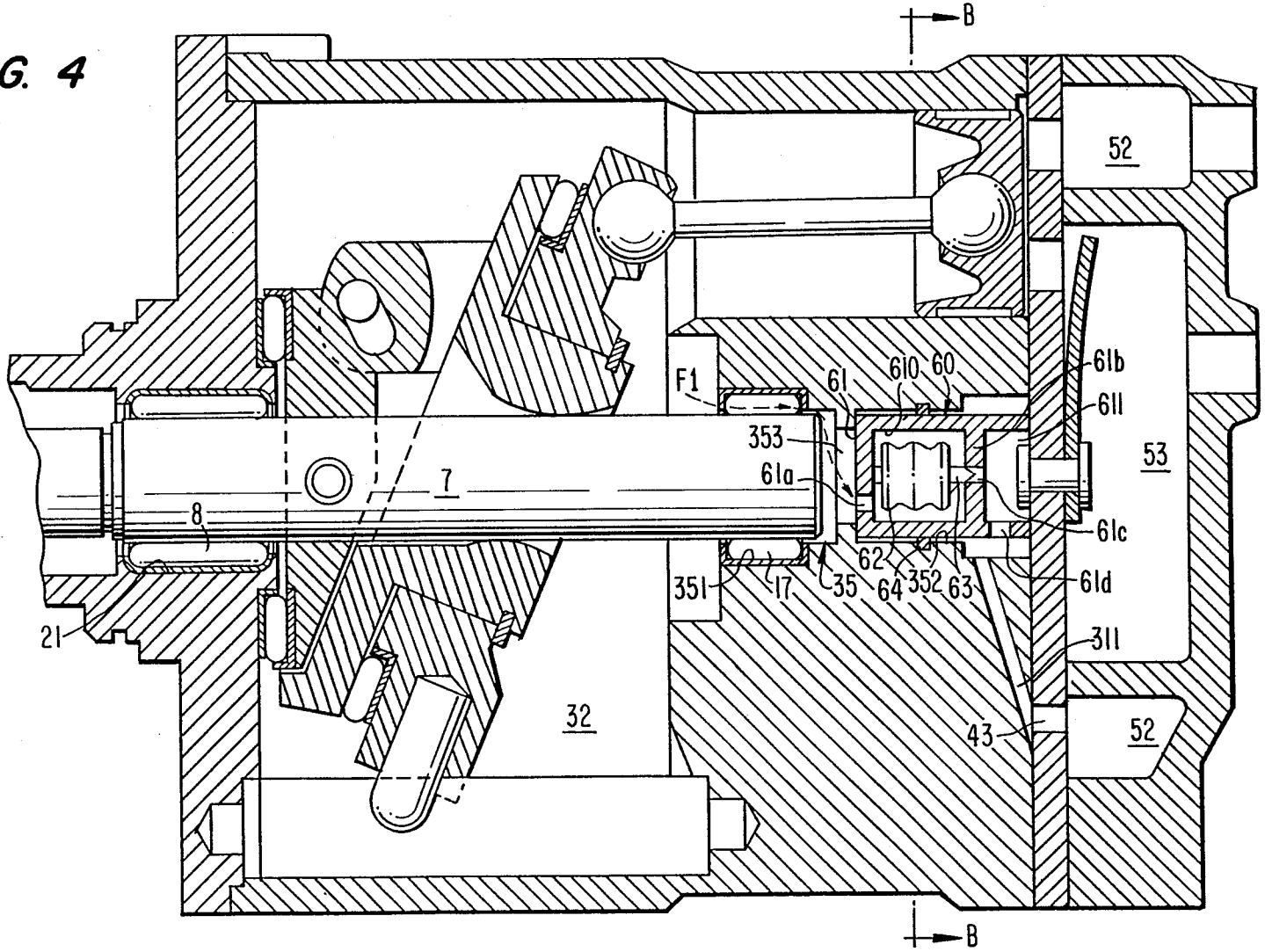
FIG. 4 is a cross-sectional view of a wobble plate type compressor with a variable displacement mechanism in accordance with one embodiment of this invention.

FIGS. 4 and 5 depict the construction of a slant plate type compressor, and more specifically, a wobble plate type compressor with a variable displacement mechanism. The same numerals are accorded on the same construction as that shown in FIGS. 1 and 2. The description of that construction is substantially omitted to simplify the description herein.

Cylinder bore 35 is formed in cylinder block 31 and is defined by first cylindrical chamber 351 and second cylindrical chamber 352. Hole or passage 353 provides communication between chambers 351 and 352. Radial bearing 8 is disposed in axial hole 21 to rotatably support one end of drive shaft 7. Radial bearing 17 which is disposed in first cylindrical chamber 351 rotatably supports the other end of shaft 7. Control valve 60 is fixedly disposed in second cylindrical chamber 352. Control valve 60 includes cylindrical casing 61, bellows 62 and needle valve 63. Hole **61*a* is formed through an axial end of cylindrical casing 61. Partition wall 61*b* radially extends from the inner surface of cylindrical casing 61 and defines the interior of cylindrical casing 61 into first casing chamber 610 and second casing chamber 611. Hole 61*c* is formed through partition wall 61*b* and provides communication between first casing chamber 610 and second casing chamber 611. Second casing chamber 611 communicates with suction chamer 52 through hole 61*d*, which is formed through the cylindrical wall surface of cylindrical casing 61, conduit 311 and hole 43. Bellows 62 is fixed on a projection, which is formed on one inner wall surface of first casing chamber 610, at one end thereof. Needle valve 63 is fixed on the other end of bellows 62 at the position corresponding to hole 61*c***.

Refrigerant gas flows into cylinder bore 35 through gaps among a plurality of balls of radial bearing 17 as shown, for example, by dotted line F1 in FIG. 4. If the pressure of the gas entering first casing chamber 610 through hole **61*a* is higher than the operating point of bellows 62, bellows 62 contracts, thereby moving needle valve 63 toward the left with reference to FIG. 4. Accordingly, the opening of hole 61*c* is opened, and the gas flows into second casing chamber 611 through hole 61*c*. The gas in second casing chamber 611 flows through hole 61*d* to the exterior of cylindrical casing 61, through conduit 311 and hole 43 and into suction chamber 52. In this open position, the pressure of the gas in crank chamber 32 is reduced and the angle of inclined plate 11 subsequently is increased. To the contrary, if the pressure of the gas in first casing chamber 610 is below the operating point of bellows 62, bellows 62 expands thereby moving needle valve 63 toward the right. Accordingly, hole 61*b* is closed by needle valve 63 and the gas in crank chamber 32 is prevented from flowing into suction chamber 52. Therefore the pressure of the gas in crank chamber 32** gradually increases.

Figure 6:
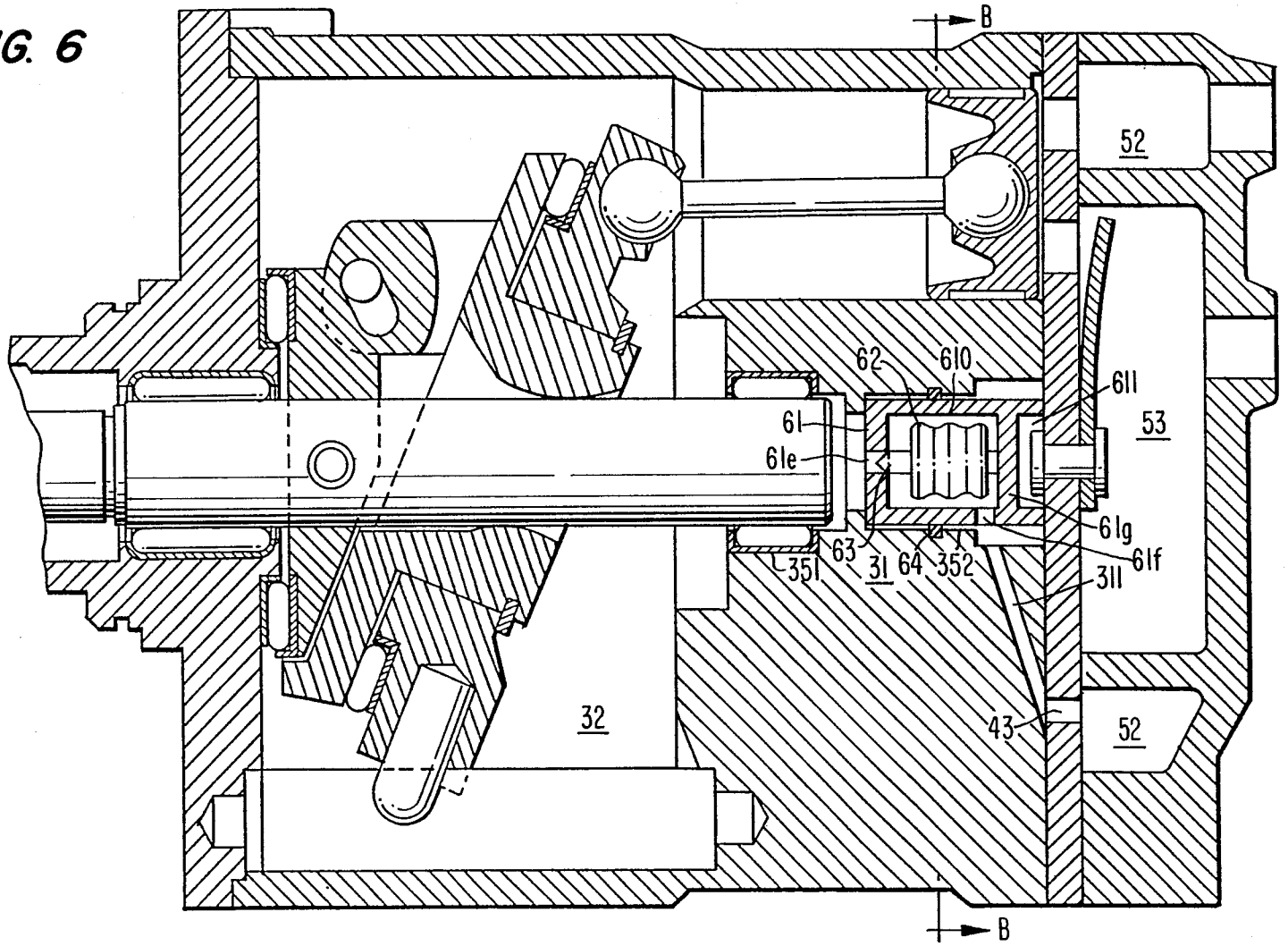
FIG. 6 is a cross-sectional view of a wobble plate type compressor with a variable displacement mechanism in accordance with another embodiment of this invention showing the valve turned 180 degrees with respect to that in FIG. 4.

FIG. 6 shows the construction of a slant plae type compressor, and more specifically, a wobble plate type compressor with a variable displacement mechanism in accordance with another embodiment of this invention. The interior of cylindrical casing 61 is defined by partition wall 61g to first casing chamber 610 and second casing chamber 611. Bellows 62 is fixed on a projection, which is formed on the inner wall surface of first casing chamber 610 at the side of discharge chamber 53. Needle valve 63 is fixed on the other end surface of bellows 62 and controls the opening and closing of hole 61e of first casing chamber 610. Hole 61f is formed through the cylindrical surface of cylindrical casing 61 to communicate first casing chamber 610 with the exterior of cylindrical casing 61 and second cylindrical chamber 352. The interior of first casing chamber 610 communicates with suction chamber 52 through conduit 311 and hole 43. If the pressure of the gas in suction chamber 52 is higher than the operating point of bellows 62, bellows 62 contracts thereby moving needle valve 63 toward the right. Accordingly, hole 61e is opened, and the gas in crank chamber 32 flows into suction chamber 52. To the contrary, if the pressure of the gas in suction chamber 52 is below the operating point of bellows 62, hole 61e is closed by needle valve 63 threby preventing the gas in crank chamber 32 from flowing into first casing chamber 610.

The interior of bellows 62 is under vacuum so that the operation of bellows 62 is not influenced by the temperature of the gas. Communication between first cylindrical chamber 351 and a portion of second cylindrical chamber 352 is prevented by seal element 62.

Although illustrative embodiments of the invention have been described in detail with respect to the accompanying drawings, it is to be understood that the invention is not limited to those precise embodiments, and that various changes and modifications may be effected therein by one skilled in the art without departing from the scope of the invention.

We claim:

1. In a slant plate type compressor with a variable displacement mechanism, the compressor comprising a compressor housing having a central portion, a front end plate at one end and a cylinder head provided with a suction chamber and a discharge chamber at its other end, said housing having a cylinder block provided with a plurality of cylinders and a crank chamber adjacent and cylinder block, a piston slidably received within each of the cylinders, a drive shaft rotatably supported in the housing, said cylinder block having a central bore rotatably supporting one end of the drive shaft, a rotor coupled to the drive shaft and rotatably therewith, coupling means for drivingly coupling said rotor to said pistons such that the rotary motion of said rotor is converted into reciprocating motion of said pistons, said coupling means including a member having a surface disposed at an incline angle relative to the longitudinal axis of the drive shaft, and control means for controlling fluid communication between the crank chamber and the suction chamber to vary the angle of said member, the stroke length of said pistons and the capacity of the compressor, the improvement comprising:

said control means being disposed in said central bore of said cylinder block adjacent said one end of said drive shaft, said control means including a control valve; and a conduit in said cylinder block extending from said central bore through said cylinder block to the suction chamber.

2. The slant plate type compressor of claim 12 wherein the control means comprises a cylindrical casing defining a first casing chamber, a bellows disposed within the chamber and having one end fixed on one inner end surface of the cylindrical casing.

3. The slant plate type compressor of claim 2 wherein a needle valve is fixed on the other end of the bellows.

4. The slant plate type compressor of claim 3 wherein the bellows is under vacuum.

5. The slant plate type compressor of claim 3 wherein a seal element surrounds an annular portion of the cylindrical casing and is sealingly disposed between the cylindrical housing and the adjacent cylinder block portion.

6. The slant plate type compressor of claim 3 wherein the needle valve is operatively associated with a first hole formed in a first wall portion of the cylindrical casing.

7. The slant plate type compressor of claim 6 wherein a second hole is formed in a second wall portion of the cylindrical casing and is in communication with the first hole and the conduit which in turn is in communication with the suction chamber.

8. The slant plate type compressor of claim 7 wherein the first hole provides a means for fluid flow communication between the crank chamber and the first casing chamber.

9. The slant plate type compressor of claim 8 wherein the cylinder block shaft support comprises a bearing having gaps among a plurality of balls therein and the gaps provide fluid flow communication between the crank chamber and the first hole of the cylindrical casing.

10. A slant plate type compressor with a variable displacement mechanism, the compressor comprising a compressor housing having a central portion, a front end plate at one end and a cylinder head provided with a suction chamber and a discharge chamber at its other end, said housing having a cylinder block provided with a plurality of cylinders and a crank chamber adjacent and cylinder block, a piston slidably received within each of the cylinders, a drive shaft rotatably supported in the housing, said cylinder block having a central bore rotatably supporting one end of the drive shaft, a rotor coupled to the drive shaft and rotatable therewith, coupling means for drivingly coupling said rotor to said pistons such that the rotary motion of said rotor is converted into reciprocating motion of said pistons, said coupling means including a member having a surface disposed at an incline angle relative to the longitudinal axis of the drive shaft, and control means or controlling fluid communication between the crank chamber and the suction chamer to vary the angle of said member the stroke length of said pistons and the capacity of the compressor, the improvement comprising:

said control means being disposed in said central bore of said cylinder block, said control means comprising a cylindrical casing forming a first casing chamber, said cylindrical casing comprising a first hole formed in a first wallportion of the cylindrical casing, a second hole formed in a second wall portion of the cylindrical casing wherein said second hole is in fluid communication with said first hole and a conduit which extends from said central bore to the suction chamber, and a third hole formed in a third wall portion of the cylindrical casing wherein said third hole provides fluid communication between the crank chamber and the first casing member, said control means further comprising a bellows disposed within said fist casing chamber said bellows having one end coupled to one inner end surface of the cylindrical casing and its other end coupled with a needle valve, said needle valve being operatively associated with said first hole.

11. The slant plate type compressor of claim 10 wherein the cylinder block includes a bearing for supporting the drive shaft, said bearing having gaps among a plurality of balls therein, and said gaps providing fluid communication between the crank chamber and said third hole in said cylindrical casing.

12. A slant plate type compressor with a variable displacement mechanism, the compressor comprising a compressor housing having a central portion, a front end plate at one end and a cylinder provided with a suction chamber and a discharge chamber at its other end, said housing having a cylinder block provided with a plurality of cylinders and a crank chamber adjacent the cylinder block, a piston slidably received within each of the cylinders, a drive shaft rotatably supported in the housing, said cylinder block having a central bore rotatably supporting one end of the drive shfat, a rotor coupled to the drive shaft and rotatable therewith, coupling means for drivingly coupling said rotor to said pistons such that the rotary motion of said rotor is converted into reciprocating motion of said pistons, said coupling means including a member having a surface disposed at an incline angle relative to the longitudinal axis of the drive shaft, and control means for controlling fluid communication between the crank chamber and the suction chamber to vary the angle of said member, the stroke length of said pistons and the capacity of the compressor, the improvement comprising:

said control means being disposed in said central bore of said cylinder block, said control means including a control valve being positioned between said one end of the drive shaft and a valve plate which is positioned between said cylinder block and said cylinder head;

means for providing fluid communication between the crank chamber and said central bore; and a conduit in said cylinder block extending from said central bore to the end of said cylinder block facing the suction chamber to provide fluid communication between said central bore and the suction chamber.

13. The slant plate type compressor of claim 12 wherein the control means comprises a cylindrical casing defining a first casing chamber, a bellows disposed within the chamber and having one end fixed on one inner end of the cylindrical casing.

14. The slant plate type compressor of claim 13 wherein a needle valve is fixed on the other end surface of the bellows.

15. The slant plate type compressor of claim 14 wherein a seal element surrounds an annular portion of the cylindrical casing and is sealingly disposed between the cylindrical housing and the adjacent cylinder block portion.

16. The slant plate type compressor of claim 14 wherein the needle valve is operatively associated with a first hole formed in a first wall portion of the cylindrical casing.

17. The slant plate type compressor of claim 16 wherein a second hole is formed in a second wall portion of the cylindrical casing and is in communication with the first hole and the conduit which in turn is in communication with the suction chamber.

18. The slant plate type compressor of claim 17 wherein a third hole is formed in a third wall portion of the cylindrical casing and provides communication between the crank chamber and the first casing chamber.

19. The slant plate type compressor of claim 18 wherein the cylinder block shaft support comprises a bearing having gaps among a plurality of balls therein, wherein the gaps provide fluid flow communication between the crank chamber and the third hole of the cylindrical casing.

20. The slant plate type compressor of claim 17 wherein the first hole provides a means for fluid flow communication between the crank chamber and the first casing chamber.

21. The slant plate type compressor of claim 20 wherein the cylinder block shaft support comprises a bearing having gaps among a plurality of balls therein, wherein the gaps provide fluid flow communication between the crank chamber and the first hole of the cylindrical casing.

* * * * *